US005374911A

United States Patent [19]

Kich et al.

[11] Patent Number: 5,374,911

[45] Date of Patent: Dec. 20, 1994

[54] TANDEM CAVITY THERMAL COMPENSATION

[75] Inventors: Rolf Kich, Redondo Beach; Richard L. Bennett, Hawthorne, both of Calif.

[73] Assignee: Hughes Aircraft Company, Los Angeles, Calif.

[21] Appl. No.: 51,027

[22] Filed: Apr. 21, 1993

[51] Int. Cl.[5] ..... H01P 1/30; H01P 1/207

[52] U.S. Cl. ..... 333/209; 333/212; 333/229

[58] Field of Search ..... 333/208–212, 333/227, 229, 230, 234, 231, 239, 233

[56] References Cited

U.S. PATENT DOCUMENTS

| | | | |
|---|---|---|---|
| 4,057,772 | 11/1977 | Basil, Jr. et al. | 333/229 |
| 4,260,967 | 4/1981 | Flieger | 333/229 X |
| 4,677,403 | 6/1987 | Kich | 333/229 |

*Primary Examiner*—Seungsook Ham

*Attorney, Agent, or Firm*—William J. Streeter; Wanda K. Denson-Low

[57] ABSTRACT

A plural cavity structure (10), suitable for use as a microwave filter (34, 34A, 34B) , has plural cavities (24, 26, 28, 30) disposed within a cylindrical aluminum housing (12) and having a central planar transverse wall (18) including an iris (38) for coupling of electromagnetic power between two successive ones of the cavities (28, 26). The transverse walls are bowed, and peripheral regions of the walls are clamped by metallic rings (66, 68, 70, 72) differing in their coefficients of thermal expansion. Thus, the rings (68, 70) of the inboard transverse walls (16, 20) are formed of titanium having a relatively high coefficient of thermal expansion, while the rings (66, 72) of the outboard transverse walls (14, 22) are formed of INVAR having a relatively low coefficient of thermal expansion. As a result of the differing coefficients of thermal expansion, the outer transverse walls experience greater deformation than do the inner transverse walls with changes in environmental temperature resulting in a net decrease in axial length of both inboard and outboard cavities upon an increase in environmental temperature.

9 Claims, 3 Drawing Sheets

TANDEM CAVITY THERMAL COMPENSATION

BACKGROUND OF THE INVENTION

This invention relates to thermal stabilization of a multiple cavity structure, wherein cylindrical cavities are arranged coaxially in tandem, as in the construction of a microwave filter of plural resonant chambers, or cavities, and, more particularly, to an arrangement of multiple cavities employing transverse bowed walls with and without coupling apertures encircled by rings of material with differing coefficients of thermal expansion to provide selected ratios of thermally induced deformation of the transverse walls to counteract changes in resonance induced by thermal expansion/-contraction of an outer cylindrical wall of the cavity structure.

Plural cavity structures are employed for microwave filters. A cavity which is frequently employed has the shape of a right circular cylinder wherein the diameter and the height (or the axial length) of the cavity together determine the value of a resonant frequency. For filters described mathematically as multiple pole filters, it is common practice to provide a cylindrical housing with transverse disc shaped partitions or walls defining the individual cavities. Irises in the partitions provide for coupling of desired modes of electromagnetic wave between the cavities to provide a desired filter function or response.

A problem arises in that changes in environmental temperature induce changes in the dimensions of the filter with a consequent shift in the resonant frequency of each filter section. For example, a filter fabricated of aluminum undergoes substantial dimensional changes as compared to a filter constructed of INVAR due to the much larger thermal coefficient of expansion for aluminum as compared to INVAR.

A solution to the foregoing problem, useful for a two-cavity filter is presented in U.S. Pat. No. 4,677,403 of Kich. Therein, an end wall of each cavity is formed of a bowed disc, while a central wall having an iris for coupling electromagnetic energy has a planar form. An increase of temperature enlarges the diameter of each cavity, and also increases the bowing of the end walls with a consequent reduction in the axial length of each cavity. The resonant frequency shift associated with the increased diameter is counterbalanced by the shift associated with the decrease in length. Similar compensation occurs during a reduction in temperature wherein the diameter decreases and the length increases.

The frequency stabilization provided by the foregoing patent is limited to the two-cavity filter having opposed thermal compensation end walls. However, there are filter situations requiring more complicated filter structure for higher pole and higher performance filters. Such filters may employ three or four cavities, by way of example, and there is a need to provide thermal compensation to such filters.

SUMMARY OF THE INVENTION

The aforementioned problem is overcome and other advantages are provided by a cylindrical filter structure of multiple cavities wherein, in accordance with the invention, there is provided a succession of transverse walls defining the cavities. Selected ones of the transverse walls provide for thermal compensation. Each of the selected transverse walls is fabricated of a bowed disc encircled by a ring formed of material of lower thermal expansion coefficient than the material of the transverse wall. Inner ones of the transverse walls are provided with irises for coupling electromagnetic power between successive ones of the cavities. By varying the composition of the rings to attain differing coefficients of thermal expansion within the rings, different amounts of bowing occur in the corresponding transverse discs with changes in temperature. Thus, the ring of an inner transverse wall has a relatively large coefficient of thermal expansion as compared to the ring of an outer one of the transverse walls, this resulting in a lesser amount of bowing of the inner wall and a larger amount of bowing of the outer wall with increase in environmental temperature and temperature of the filter.

In a preferred embodiment of the invention, the housing is constructed of aluminum, as is a central planar transverse wall having a coupling iris. The other transverse walls, both to the right and to the left of the central wall, are provided with a bowed structure, the bowed walls being encircled by metallic rings. The inboard rings nearest the central wall are fabricated of titanium, and the outboard rings are fabricated of INVAR. The INVAR has a lower coefficient of thermal expansion than does the titanium and, accordingly, the peripheral portions of the outboard walls, in the case of a four-cavity structure, experience a more pronounced bowing upon a increase in environmental temperature than do the inner walls which are bounded by the titanium rings having a larger coefficient of thermal expansion.

The reason for the use of the rings of differing coefficients of thermal expansion is as follows. Deflection of an inboard wall reduces the axial length of an inner cavity,on the inner side of the wall, while increasing the axial length of an outer cavity, on the opposite side of the wall, with increasing temperature. Thus, the inboard wall acts in the correct sense to stabilize the inner cavity bit in the incorrect sense for stabilization of the outer cavity. Accordingly, in stabilizing the outer cavity by means of the outer wall, it is necessary to provide an additional bowing to overcome the movement of the inboard wall, thereby to stabilize thermally the outer cavity.

By way of alternative embodiments, if desired, one of the outboard cavities may be deleted leaving a structure of only three cavities. Thereby, the technique of construction of the filter, in accordance with the preferred embodiment, applies to a structure having an equal number of cavities on each side of the planar transverse wall as in a four-cavity filter structure, as well as to a structure having an unequal number of cavities on opposite sides of the planar transverse wall as in a three-cavity structure.

BRIEF DESCRIPTION OF THE DRAWING

The aforementioned aspects and other features of the invention are explained in the following description, taken in connection with the accompanying drawing wherein.

DETAILED DESCRIPTION

Figure 1:
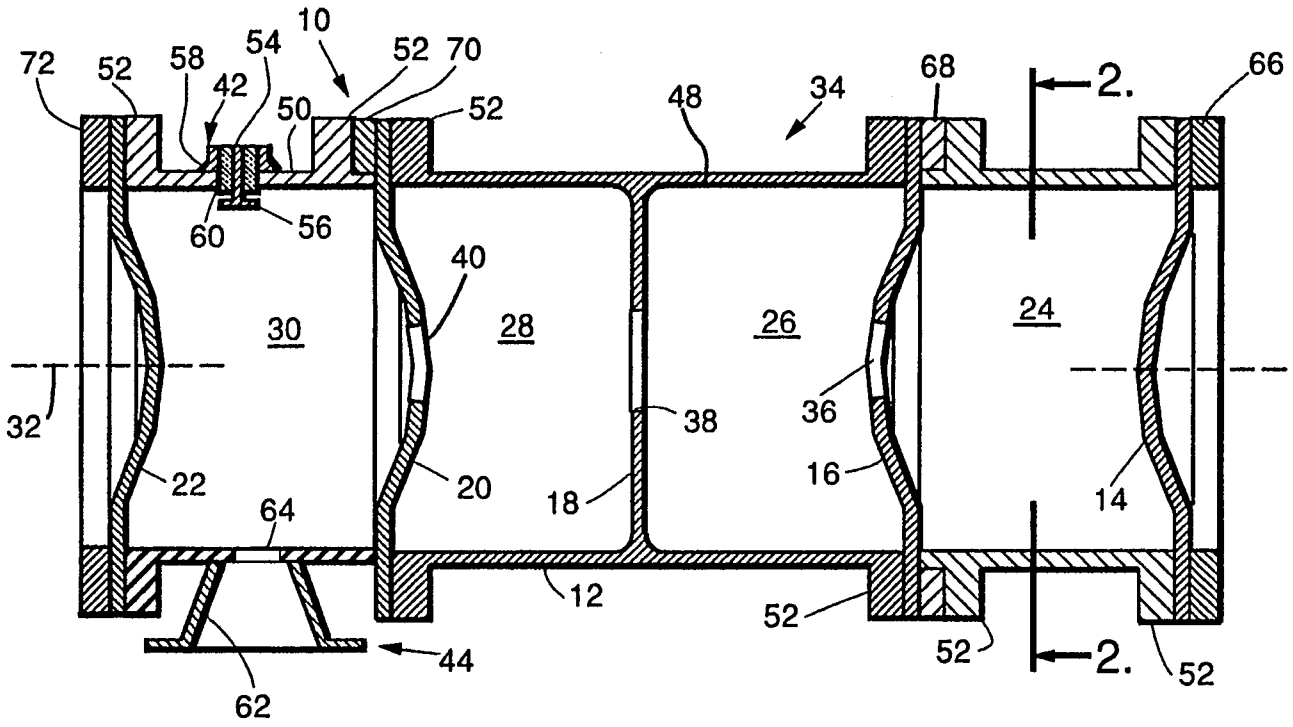
FIG. 1 shows a longitudinal sectional view of a four-cavity structure employing transverse walls in the form of bowed discs for thermal compensation, in accordance with the invention.
Figure 2:
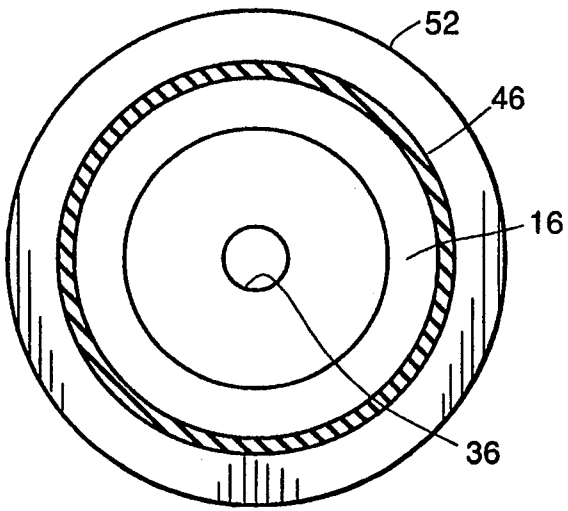
FIG. 2 is a transverse sectional view of the plural-cavity structure taken along the line 2—2 in FIG. 1.

FIGS. 1 and 2 show a plural-cavity structure 10 having an outer cylindrical housing 12 and a set of five transverse walls 14, 16, 18, 20, and 22 which define a set of four cavities 24, 26, 28, and 30 which are arranged in tandem along a longitudinal axis 32 of the structure 10. The walls 14 and 22 serve as end walls of the structure 10, and the walls 16, 18, and 20 serve as partitions which provide separation between the cavities 24, 26, 28, and 30. The housing 12 and the transverse walls 14, 16, 18, 20, and 22 are formed of an electrically conductive material, preferably a metal such as aluminum.

The structure 10 is employed advantageously as a microwave filter 34 by placing apertures in the partition walls 16, 18, and 20 to form irises 36, 38, and 40, respectively, to enable a coupling of electromagnetic power between successive ones of the cavities 24, 26, 28, and 30. Also, an input port 42 and an output port 44 are located at the cavity 30 to enable the coupling of an input microwave signal into the filter 34, and to enable extraction of a filtered version of the microwave signal from the filter 34. The housing 12 is fabricated as an assembly of circular cylindrical wall sections 46, 48, and 50 which are provided with flanges 52 at end regions of the wall sections 46, 48, and 50 to enable a securing of the wall sections 44. 46, and 48, as by use of bolts (to be described in FIG. 3), to form the housing 12. The input port 42 and the output port 44 are disposed on the wall section 50.

By way of example in the construction of the filter 34, the input port 42 is constructed as a probe extending into the cavity 30, the probe being formed as a metal shank 54 terminating in a button 56, and being insulated from an outer conductor 58 by a cylindrical insulator 60. Also, by way of example, the output port 44 is constructed as a section of waveguide 62 of varying cross section, and has a coupling slot 64 formed within the wall section 50 for communication of electromagnetic power between the cavity 30 and the waveguide 62.

In accordance with the invention, it is recognized that the aluminum of the housing 12 and of the transverse walls 14, 16, 18, 20, and 22 expands with increasing environmental temperature and contracts with decreasing environmental temperature, this providing a corresponding increase or decrease in the interior dimensions and volume of each of the cavities 24, 26, 28, and 30. Such change in the interior dimensions and the volume of each of the cavities 24, 26, 28, and 30 provides for a shift in the resonant frequency of electromagnetic signals in respective ones of the cavities. Such a shift in resonant frequency alters the transfer functions of the filter 34. The invention provides for thermal compensation of the filter 34 so as to preserve its frequency characteristics independently of a change in the temperature of the filter 34, such as is brought on typically by a change in environmental temperature. The thermal compensation is accomplished by configuring the end walls 14 and 22, and the outboard partition walls 16 and 20 with a bowed configuration, while the central partition wall 18 is retained in a planar form. Furthermore, the bowed walls 14, 16, 20, and 22 are provided with clamping rings 66, 68, 70 and 72, respectively, wherein each of the clamping rings is secured about the peripheral portion of the corresponding one of the bowed walls.

Figure 5:
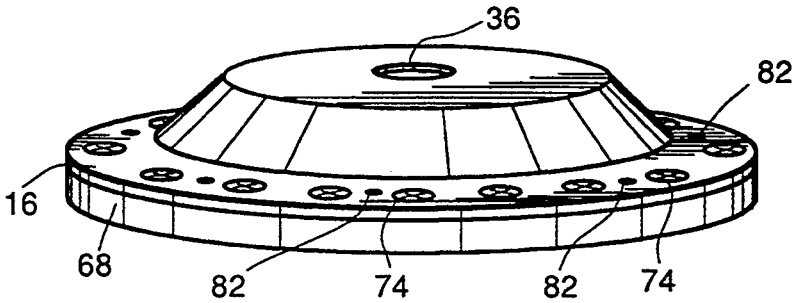
FIG. 5 is an isometric view of a transverse wall employed in the plural-cavity structures of FIGS. 1,2 and 3.
Figure 6:
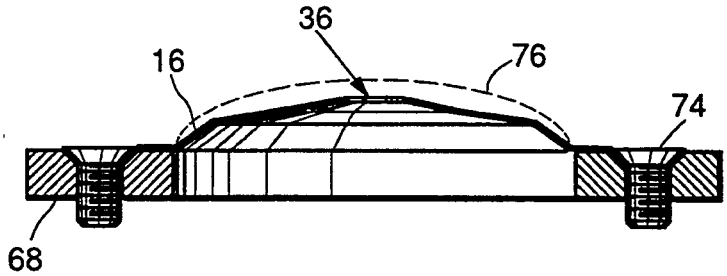
FIG. 6 is a sectional view of the transverse wall of FIG. 4.

In a preferred embodiment of the invention, as shown in FIGS. 5 and 6, the transverse wall 16 is secured to its clamping ring 68 by a set of screws 74 which are positioned uniformly about the circular periphery of the wall 16 to provide for secure clamping of the peripheral portion of the wall 16 to the ring 68. Secure connection of the transverse wall 16 to the ring 68 can be accomplished alternatively by way of diffusion bonding or welding, by way of example. The wall 16 is fabricated as an aluminum disc which is relatively thin, as compared to the substantially thicker ring 68. The ring 68 is formed of a material, such as a metal, having a coefficient of thermal expansion which is lower than the coefficient of thermal expansion of the aluminum disc of the wall 16. As a result of this difference in the coefficients of thermal expansion, the peripheral region of the wall 16 is allowed to expand only slightly with increasing environmental temperature while the central portion of the wall 16 is free to expand with a resultant increased bowing of the wall 16 as indicated in phantom at 76. The reverse effect, with reduced bowing of the wall 16, occurs upon a reduction in the environmental temperature. The foregoing description of the securing of the transverse wall 16 to the ring 68 of lesser coefficient of thermal expansion applies also to the wall 14 with its ring 66 (FIG. 1), the wall 20 with its ring 70, and the wall 22 with its ring 72.

In accordance with a further feature of the invention, it is recognized that the bowing of the wall 16 (FIG. 1) upon an increase of environmental temperature, moves the central portion of the wall 16 towards the central wall 18 with a consequential reduction in the length of the cavity 26 as measured along the axis 32 while, simultaneously, providing an increase in the length of the adjacent cavity 24. However, the desired thermal compensation requires that the axial length of the cavity 24 be reduced. Accordingly, the invention provides that the movement of the central portion of the wall 14 along the axis 32, toward the central wall 18, during an increase of environmental temperature, be greater than the corresponding movement of the central portion of the wall 16. This provides for a net reduction in the spacing between the central portions of the wall 14 and 16 with a corresponding reduction in the axial length of the cavity 24. The amount of thermally induced bowing of the walls 14, 16, 20 and 22, and hence, the amount of movement of the central portions of these walls towards the central wall 18 is dependent on the difference in the thermal coefficients of expansion between each wall 14, 16, 18, and 20, and its corresponding clamping ring 66, 68, 70, and 72. Accordingly, in order to provide for the additional movement of the wall 14 relative to the wall 16, the rings 66 and 68 are fabricated of materials having different coefficients of thermal expansion. Similarly, with respect to the walls 22 and 20 on the left side of the central wall 18, it is necessary to provide for additional movement of the central portion of the wall 22 relative to the central portion of the wall 20, as the central portions of both of these walls advance towards the central wall 18 with increase in temperature. Accordingly, the clamping rings 70 and 72 of the walls 20 and 22 are fabricated of materials having different coefficients of thermal expansion.

In a preferred embodiment of the invention, the inner clamping rings 68 and 70 are fabricated of titanium, and the outer clamping rings 66 and 72 are fabricated of INVAR so as to enable these rings to provide the desired amount of thermal compensation. The coefficient of thermal expansion of the titanium of the rings 68 ad 70 is lower than that of the aluminum of the housing 12 and of the transverse walls 14, 16, 18, and 20. The coefficient of thermal expansion of the INVAR of the rings 66 and 72 is lower than that of the titanium of the rings 68 and 70. With an increase in temperature, the expansion of the titanium rings 68 and 70 is less than that of the transverse walls 16 and 20 to provide the thermally induced bowing of the transverse walls 16 and 20. The INVAR rings 66 and 72 experience almost no circumferential expansion with a consequential larger amount of thermally induced bowing of the walls 14 and 22. The titanium and the INVAR are presented by way of example for use with the aluminum transverse walls, and it is to be understood that other materials having similar coefficients of thermal expansion (CTE) to the titanium and the INVAR may be employed to attain a desired balancing of thermal expansion characteristics. Such materials may include metal alloys or graphite composites, by way of example, wherein the composition of the material can be adjusted to match numerous metals which may be employed in constructing the plural cavity structure 10. Thereby, the invention attains its desired thermal compensation of the structure 10 by decreasing the axial lengths of all of the cavities 24, 26, 28, and 30 by an amount inverse to the circumferential expansion of the wall sections 46, 48, and 50. This stabilizes the frequency characteristic of the filter 34 which remains constant with increasing environmental temperature. In similar fashion, a reduction of environmental temperature causes the central portion of the walls 14, 16, 18 and 22 to move away from the central wall 18 so as to enlarge the axial lengths of all of the cavities 24, 26, 28, and 30 in an amount inverse to the circumferential contraction of the wall sections 46, 48, and 50 so as to provide for stabilization of the characteristics of the filter 34 during a decreasing temperature.

Figure 3:
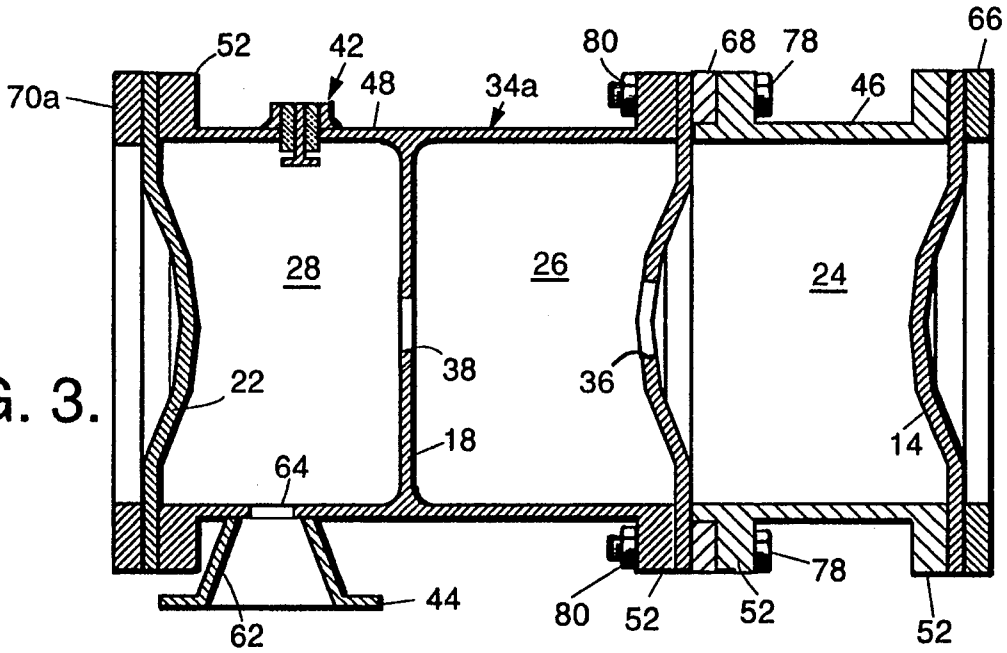
FIG. 3 is a sectional view of a plural-cavity structure, similar to that of FIG. 1, but having one less cavity.

FIG. 3 shows a filter 34A which is alternative embodiment of the filter 34 of FIG. 1. The filter 34A is obtained by deleting the cavity 30 of the filter 34 so as to provide for the three-cavity filter of FIG. 3. The input port 42 and the output port 44 of the filter 34A are relocated to the cavity 28, and are mounted in the circumferential cylindrical wall section 48 in the same fashion as described for the mounting of the input port 42 and the output port 44 to the cylindrical wall section 50 of FIG. 1. In FIG. 3, a titanium ring 70A, similar in construction to the titanium ring 70 (FIG. 1) is secured to the left end of the filter 34A, so as to ensure that the movement of the transverse wall 22, located at the left side of the cavity 28 in FIG. 3, is the same as that of the transverse wall 20 which is located on the left side of the cavity 28 in FIG. 1. Thereby, thermal compensation of the cavity 28 is identical in both FIGS. 1 and 3.

Also shown in FIG. 3 is an interconnection of flanges 52 by means of bolts 78 and nuts 80 which are secured by threads to the bolts 78. Two of the bolts 78 are shown, by way of example, for securing the flanges 52 on both sides of the wall 16, it being understood that there are additional ones of the bolts 78 extending in a uniform array about the circumferences of the flanges 52, with a similar array of bolts 78 (not shown) being employed for securing the flanges 52 on the opposite sides of the wall 20 (FIG. 1), as well as for securing the end rings 66 and 72 (FIG. 1) to their respective flanges 52. The bolts 78 pass through enlarged through-holes such as the through-holes 82 (FIG. 5), by way of example, in the wall 16 and in its thermal-compensation clamping ring 68. The enlarged through holes 82 allow for differential expansion between a clamping ring and the adjacent flange(s) 52.

Figure 4:
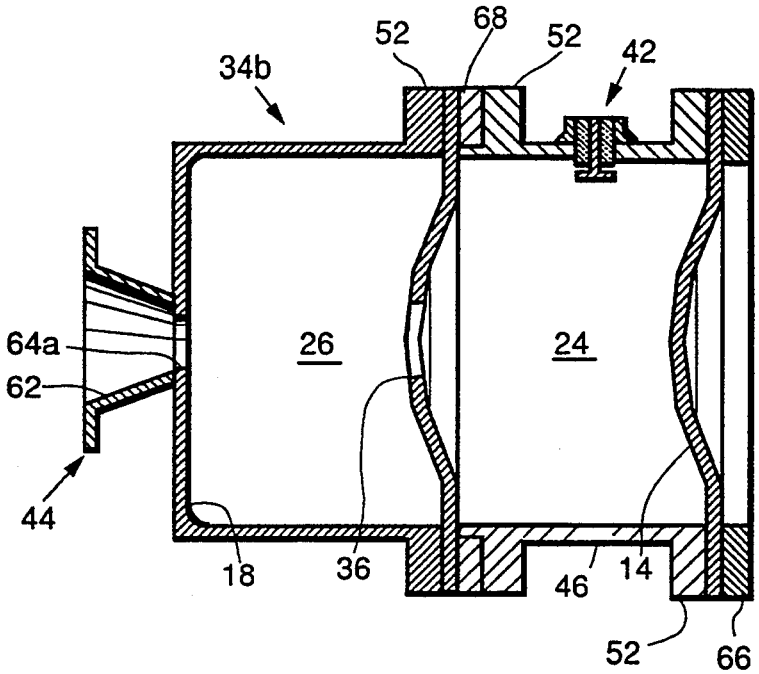
FIG. 4 is sectional view of a plural-cavity structure, similar to that of FIG. 1, but with two cavities deleted.

FIG. 4 shows a filter 34B which is attained by deleting the cavities 30 and 28 from the filter 34 of FIG. 1. In addition, FIG. 4 demonstrates an alternative locating of the input port 42 and the output port 44 such that, by way of example, the input port 42 is located in the cylindrical wall section 46 of the cavity 24 while the output port 44 is located in the transverse wall 18 of the cavity 26. Coupling of electromagnetic power between the section of waveguide 62 and the cavity 26 is accomplished by an aperture 64A located in the transverse wall 68. Movement of the transverse walls 16 and 14 relative to the transverse wall 18 of the filter 34B (FIG. 4) with changing temperature is the same as that disclosed above for the filter 34 (FIG. 1).

With reference to FIG. 1, further accuracy in the thermal compensation is attained by configuring the transverse walls 14 and 16, and similarly, the transverse walls 20 and 22, with slightly different configurations of bow so as to adjust a desired amount of differential movement between the walls 14 and 16, as well as between the walls 20 and 22, with changes in the temperature of the structure 10. The resulting thermal compensation has been found to be superior to that of a filter constructed, as in the prior art, completely of INVAR. Also, the aluminum components of the filter are fabricated more easily and at less expense than other materials used heretofore. The coupling irises 36, 38, and 40 may be given any desired shape such as a slot, a crossed slot, a circle, or a ellipse, by way of example, so as to provide for a desired amount of coupling between various modes of electromagnetic vibration within the cavities of the filter 34, thereby to attain a desired frequency characteristic, or filter function, to the filter 34 (FIG. 1) and similarly to the filters 34A (FIG. 3) and 34B (FIG. 4). In each of the bowed transverse walls 14, 16, 20, and 22, the convex side of the wall faces the planar transverse wall 18 for transverse walls constructed of material having a positive coefficient of thermal expansion as is the case for materials normally used in the construction of filters. However, in the event that the bowed transverse walls were constructed of material having a negative coefficient of thermal expansion, then the convex side of the bowed transverse walls would face away from the planar transverse wall 18. The coefficients of thermal expansion of the material disclosed above for construction of the filter 34 are as follows: the aluminum coefficient is 13 parts per million (ppm), the titanium coefficient is 6 ppm, and the INVAR coefficient is 1.3 ppm.

It is noted also that the practice of the invention for thermally stabilizing the structure 10 is applicable independently of the use of the structure 10. While the preferred use is as a microwave electromagnetic filter, it is noted that a metallic structure of plural tandem cavities may find use also for acoustic purposes, such as for a tuning of an acoustic system. In such a case, sonic energy may enter one of the cavities and exit via another of the cavities, by way of example. Also, by way of further embodiments of the invention, additional bowed transverse walls may be inserted to define additional cavities wherein each of the additional bowed walls has a peripheral region clamped by a thermal-compensation clamping ring with coefficient of thermal expansion different from those of other clamping rings on same side of the planar transverse wall. Such an arrangement of transverse walls and their clamping rings permits implementation of selective and differing amounts of movement of central portions of the bowed transverse walls for compensation of a series of cavities disposed on a first side as well as a second side of the planar transverse wall.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A thermally-compensated plural-cavity structure comprising:

a cylindrical wall assembly enclosing a plurality of cylindrical cavities arranged in tandem along a central axis of the wall assembly;

a plurality of transverse walls extending normally to said axis and defining end surfaces of said cavities, a first transverse wall of said plurality of transverse walls being planar, a second transverse wall of said plurality of transverse walls being bowed and having a coupling iris for coupling electromagnetic power between adjacent cavities of said plurality of cavities, and a third transverse wall of said plurality of transverse walls being bowed, said second transverse wall being located between said first transverse wall and said third transverse wall;

a first clamping ring having a lower coefficient of thermal expansion than said second transverse wall and being secured about a periphery of said second transverse wall, and a second clamping ring having a lower coefficient of thermal expansion than said third transverse wall and being secured about a periphery of said third transverse wall;

wherein a first ratio of coefficients of thermal expansion of said first clamping ring and said second transverse wall resulting in a deformation of said second transverse wall with movement of a central portion of said second transverse wall along said axis in a first direction with increasing temperature;

a second ratio of coefficients of thermal expansion of said second clamping ring and said third transverse wall resulting in a deformation of said third transverse wall with movement of a central portion of said third transverse wall along said axis in said first direction with increasing temperature; and said second ratio is smaller than said first ratio to provide for greater movement of said central portion of said third transverse wall than the movement of said central portion of said second transverse wall to provide for thermal compensation of a cavity disposed between said first transverse wall and said second transverse wall and of a cavity disposed between said second transverse wall and said third transverse wall.

2. A plural-cavity structure according to claim 1 wherein said second transverse wall is disposed on a first side of said first transverse wall and spaced apart from said first transverse wall; said plurality of walls includes a fourth transverse wall being bowed;

said plural-cavity structure further comprises a third clamping ring having a lower coefficient of thermal expansion than said fourth transverse wall, said fourth transverse wall being disposed on a second side of said first transverse wall opposite said first side and spaced apart from said first transverse wall; and wherein a third ratio of coefficients of thermal expansion of said third clamping ring and said fourth transverse wall results in a deformation of said fourth transverse wall with movement of a central portion of said fourth transverse wall along said axis in a second direction opposite said first direction with increasing temperature to provide for thermal compensation to a cavity disposed between said fourth transverse wall and said first transverse wall.

3. A plural-cavity structure according to claim 2 wherein said plurality of transverse walls includes a fifth transverse wall, said fourth transverse wall being disposed between said fifth transverse wall and said first transverse wall;

said plural-cavity structure further comprises a fourth clamping ring having a lower coefficient of thermal expansion than said fifth transverse wall and being secured about a periphery of said fifth transverse wall; and wherein a fourth ratio of thermal expansion of said fourth clamping ring and said fifth transverse wall results in a deformation of said fifth transverse wall with movement of a central portion of said fifth transverse wall along said axis in said second direction with increasing temperature, and said fourth ratio is smaller than said third ratio to provide for greater movement of said central portion of said fifth transverse wall than the movement of said central portion of said fourth transverse wall to provide for thermal compensation to a cavity disposed between said fourth transverse wall and said fifth transverse wall.

4. A plural-cavity structure according to claim 3 wherein each of said transverse walls is constructed of a material, the material in all of said transverse walls being the same.

5. A plural-cavity structure according to claim 4 wherein a cylindrical wall of said wall assembly has a coefficient of thermal expansion which is equal to that of the material of said transverse walls.

6. A plural-cavity structure according to claim 5 wherein said first clamping ring and said third clamping ring are constructed of a material having the same coefficient of thermal expansion of titanium.

7. A plural-cavity structure according to claim 6 wherein said cylindrical wall of said wall assembly is fabricated of aluminum, each of said transverse walls is fabricated of aluminum, and said fourth transverse wall has an iris for coupling electromagnetic power between cavities disposed on opposite sides of said fourth transverse wall.

8. A plural-cavity structure according to claim 7 wherein said structure is a microwave filter having an input port disposed in a wall of one of said cavities, and an output port disposed in a wall of one of said cavities.

9. A plural-cavity structure according to claim 3 wherein each of said second and said third and said fourth and said fifth transverse walls has a convex surface facing said first wall, said first direction of movement being towards said first side of said first wall and said second direction of movement being toward said second side of said first wall.

* * * * *